US009045264B2

(12) United States Patent
Pils

(10) Patent No.: US 9,045,264 B2
(45) Date of Patent: Jun. 2, 2015

(54) CONTAINER HAVING AN ARTICULATED PIVOTING COVER

(75) Inventor: Volker Pils, Weitefeld (DE)

(73) Assignee: FRITZ SCHAEFER GMBH, Neunkirchen (DE)

( * ) Notice: Subject to any disclaimer, the term of this patent is extended or adjusted under 35 U.S.C. 154(b) by 0 days.

(21) Appl. No.: 14/113,847

(22) PCT Filed: Mar. 27, 2012

(86) PCT No.: PCT/EP2012/001374

§ 371 (c)(1),
(2), (4) Date: Dec. 20, 2013

(87) PCT Pub. No.: WO2012/146341

PCT Pub. Date: Nov. 1, 2012

(65) Prior Publication Data

US 2014/0175108 A1 Jun. 26, 2014

(30) Foreign Application Priority Data

Apr. 29, 2011 (DE) ..... 20 2011 100 005 U

(51) Int. Cl.
*B65D 43/16* (2006.01)

(52) U.S. Cl.
CPC ..... *B65D 43/166* (2013.01); *B65D 43/164* (2013.01)

(58) Field of Classification Search
CPC .... B65D 43/164; B65D 43/163; B65D 43/16; B65D 43/166
USPC ..... 220/810, 845, 244, 263, 283, 843, 4.22; 16/50, 221
See application file for complete search history.

(56) References Cited

U.S. PATENT DOCUMENTS

| | | | | |
|---|---|---|---|---|
| 2,571,714 | A | 10/1951 | Henchert | |
| 3,456,913 | A * | 7/1969 | Lutz | 249/63 |
| 4,349,120 | A | 9/1982 | DiNardo | |
| 5,156,661 | A | 10/1992 | Adiletta | |
| 6,321,925 | B1 | 11/2001 | Crouse | |
| 7,753,228 | B2 * | 7/2010 | Yuhara | 220/835 |
| 2006/0026795 | A1 * | 2/2006 | Tonelli | 16/221 |
| 2006/0191948 | A1 | 8/2006 | Wisniewski | |
| 2006/0283869 | A1 * | 12/2006 | Soncini | 220/836 |
| 2012/0199513 | A1 * | 8/2012 | Wagner | 206/505 |

FOREIGN PATENT DOCUMENTS

| | | | |
|---|---|---|---|
| CH | 682144 | B | 7/1993 |
| DE | 202007008261 | U | 12/2007 |
| EP | 0526742 | A | 2/1993 |

* cited by examiner

*Primary Examiner* — Robert J Hicks
*Assistant Examiner* — Kareen Rush
(74) *Attorney, Agent, or Firm* — Andrew Wilford

(57) ABSTRACT

The invention relates to a container (1) having a cover (2) which is connected to the container (1) by at least two hinge arrangements (3) so that it can be opened and closed about a pivot axis (a) relative to the container (1). For permanent attachment of the cover to the container each hinge arrangement (3) comprises: a hinge gudgeon (4) disposed on the cover (2) with a casing section (5) formed in some sections in a dish shape on which a web (6) extending in the direction of the pivot axis (a) is formed; and a slot (7) introduced into the upper edge region of the container (1) and extending in the direction of the pivot axis (a) for receiving the casing section (5) formed in some sections in a dish shape, wherein the extent (b) of the casing section (5) together with the web (6) measured in the direction of the pivot axis (a) is greater than the extent (c) of the slot (7) measured in the direction of the pivot axis (a).

12 Claims, 9 Drawing Sheets

CONTAINER HAVING AN ARTICULATED PIVOTING COVER

CROSS REFERENCE TO RELATED APPLICATIONS

This application is the US-national stage of PCT application PCT/EP2012/001374 filed 27 Mar. 2012 and claiming the priority of German patent application 202011100005.6 itself filed 29 Apr. 2011.

FIELD OF THE INVENTION

The invention relates to a container having a cover that is attached to the container by at least two hinges so that the cover can be opened and closed by pivoting about an axis relative to the container.

BACKGROUND OF THE INVENTION

This container functions, for example, as a transport and storage box, and is composed of plastic, in particular; it can be is produced by injection molding. The cover is constructed so as to be pivotable on the container via hinges at the upper rim of the container. The hinges or hinge knuckles that are made unitarily with the cover are inserted or snapped into slots that are formed in the upper rim of the container. This enables the cover to be attached to the container.

The approach is well known whereby the cover includes at least two hinge lugs on one side fittable into slots on the upper rim of the container, thus enabling the container to be attached to the cover.

A variety of hinge types exist, such as, for example, half-shell-like hook hinges that engage into the upper rim of the container. The cover is then rotated 180° onto the container, thereby closing the container. The disadvantage of this type of hinge, however, is the fact that rotating the cover away from the container by 180° to open the container causes the hook of the hinge usually also to rotate out of the slot on the upper rim of the container, with the result that the cover is no longer attached to the container.

An improvement of this hinge is the so-called "hinge knuckle" that is radially closed except for a longitudinal slit that runs through the central plane of the hinge or is provided there. With such a hinge knuckle, the hinge essentially surrounds the entire upper rim and is attached to the upper rim only through the slot.

However, the disadvantage here too is that the cover can detach from the container when opened and closed. A supplemental component is needed to prevent this. This specifically is a metal bracket that surrounds the hinge and closes the open slit of the hinge. Although this approach enables the cover to be captured on the container, this bracket entails additional assembly work; furthermore, it generates additional costs. If the cover is to be installed at a later time (by the user of the container, for example), it will always be necessary to include in the delivery a technical tool, specifically, special pliers for removing and re-attaching the brackets.

A further disadvantage is the fact that these types of (plastic) container cannot be completely recycled since the brackets are composed of metal.

OBJECT OF THE INVENTION

The object of the invention is therefore to develop a container of the above-described type so as to avoid the above-referenced disadvantages. The object accordingly is to enable the cover to be captured on the container without having to employ special components (brackets). In addition, the object is for both the container and also the cover to be produced exclusively out of plastic so as to avoid any problems in terms of recycling and allow only plastic parts to be recycled. The object finally is also to enable the cover to be easily installed on the container.

SUMMARY OF THE INVENTION

This object is achieved according to the invention by an approach wherein each hinge comprises: a hinge knuckle on the cover and having an arcuate wall section onto which a lug is molded that extends generally parallel to the pivot axis, a slot formed in an upper rim of the container receiving the arcuate wall section and extending parallel to the pivot axis, a length of the arcuate wall section measured generally parallel to the pivot axis together with the molded-on lug being greater than length of the slot generally parallel to the pivot axis.

The arcuate wall section here is preferably cylindrically tubular.

The lug preferably extends only over an outer surface portion of the arcuate wall section. The outer surface portion including the lug here preferably extends over an angle of between 15° and 45°.

The arcuate wall section furthermore preferably is formed with a cutout at an end of the wall section opposite the lug. The cutout here preferably extends through an angle of between 15° and 45°. Provision is preferably made here whereby the lug and the cutout extend over the same outer surface portion of the arcuate wall section.

The length of the lug measured generally parallel to the pivot axis preferably ranges here between 75% and 125% of the length of the cutout measured generally parallel to the pivot axis. In particular, the length of the lug measured parallel to the pivot axis and the length of the cutout measured parallel to the pivot axis can be the same.

The lug is preferably provided with a radial offset on the radial outer surface of the arcuate wall section. The radial offset can be created here by a step-like shoulder.

The arcuate wall section can be molded onto the cover so as to create an opening (slit) that extends generally parallel to the pivot axis. The slit preferably has a width with an angular dimension of between 10° and 45° of the arcuate wall section.

The lug can be formed with at least one flat or chamfer in its end opposite the arcuate wall section. This facilitates installation of the cover on the container.

The hinge knuckle is preferably on an edge of the cover.

The arcuate wall section can be molded unitarily with the is cover and be composed of the same material as the cover.

The cover together with the arcuate wall section is preferably molded here using a shared injection molding process.

The slots in the container are preferably formed simultaneously during the injection-molding process when the container is being manufactured.

The container and the cover are preferably composed of plastic, in particular, of a thermoplastic material.

The invention enables a container to be made together with its cover such that a hinge or hinge knuckle is used that is stepped as viewed lengthwise. The hinge knuckle here is provided at one end with a lug-like extension such that the overall length of the knuckle is somewhat greater than the length of the slot in the upper rim of the container that receives the hinge. It is thus advantageously now impossible for the hinges to automatically detach from their clasping means or attachment means in the container slots because the cover is captured.

At the same time, the stepped configuration allows for simple installation. The stepped configuration specifically provides freedom of movement within the container slot during installation, attachment, or fastening of the cover to the container after the hinge knuckles including their lugs (lug-like extensions) and part of their outer surfaces that adjoin and reach to the cutouts (corner notches) on the ends of the hinge knuckles opposite the lug-like extensions when initially they have been positioned on and then inserted into the opening cross-sections of the container slots, and the cover is then rotated slightly toward its closed position, the rotation angle being restricted by the depth (relative to the circumference of the hinge knuckle) of the recesses (corner notches in the form of step-like indentations). In this intermediate angular position, the lugs are in the container slots on a plane that runs below the container's upper rim. The cover together with its hinge knuckles can therefore be displaced toward the end of the lugs such that the lugs engage under the container's upper rim, while the cutouts (corner notches) move into the region of the container slots, with the result that the hinge knuckles can be completely rotated into the container slots, enclosing the slots' outer fronts limiting the lugs with the shell-like wall section of the hinge knuckles, in response to turning the cover all the way to its closed position.

The hinge knuckles are thus designed so that on the one hand their shell-like wall sections are closed over their outer surface except for a gap, to which end the curved section terminates with a certain clearance short of the outer edge of the cover edge, which clearance is slightly wider than the thickness of the container's upper rim except for the cutouts (corner notches). On the other hand, they are formed on the one hinge knuckle end the cutouts (corner notches) creating a step in the shell-like wall section, and form toward the other hinge knuckle end a shoulder that projects upward from the shell-like wall section and creates another step onto which the lug-like extension is molded that runs parallel to the gap, thus also delimiting this gap a certain spacing from the outer edge of the cover edge, and extends beyond the hinge knuckle end.

The length of the cutout (i.e. corner notch) in the wall section approximately matches the length of the lug-like extension.

BRIEF DESCRIPTION OF THE DRAWING

An embodiment of the invention is shown in the drawing. Therein.

SPECIFIC DESCRIPTION OF THE INVENTION

Figure 1:
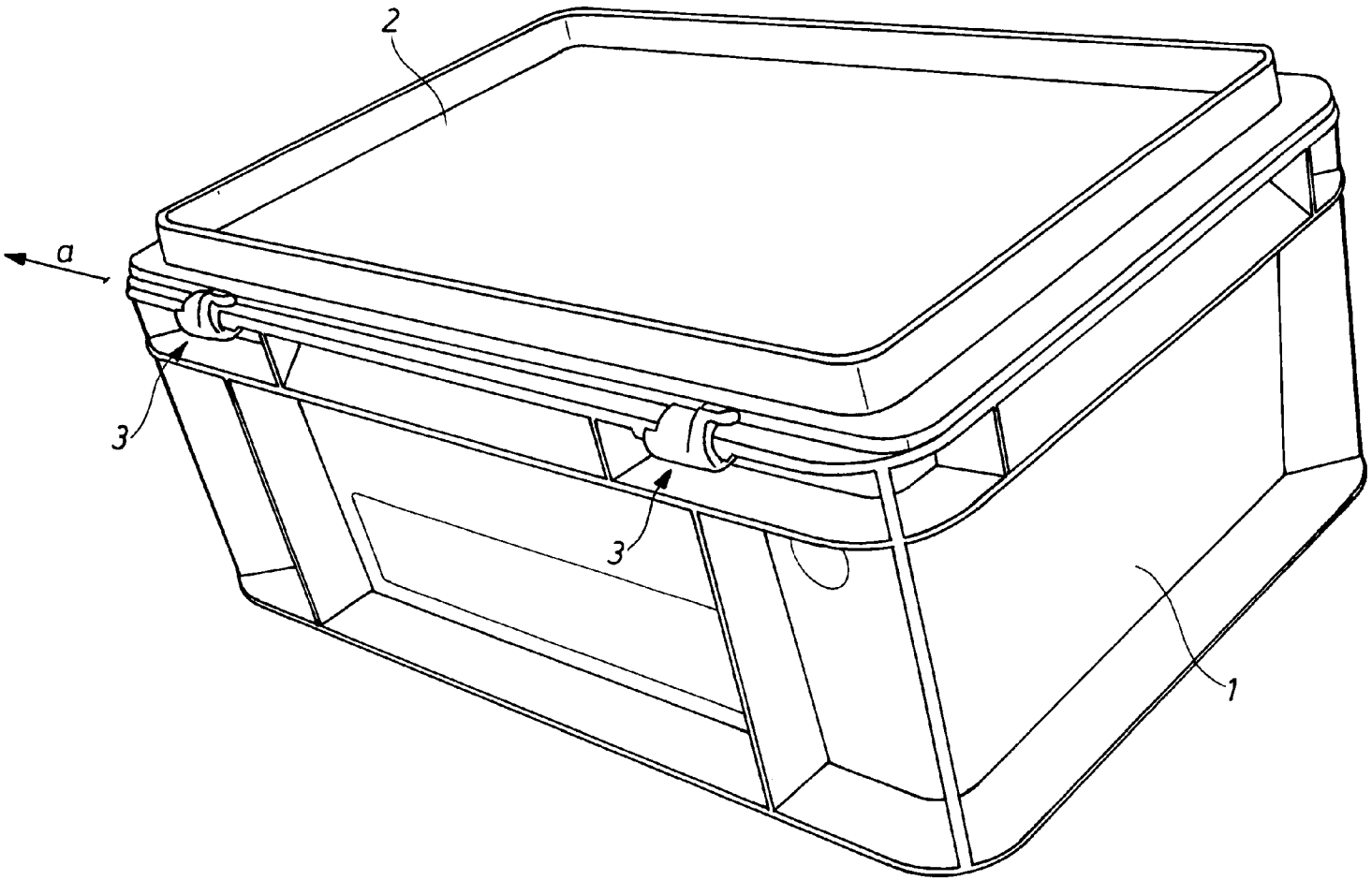
FIG. 1 is a perspective view of a container together with its cover, the cover being in the closed position.

FIG. 1 shows a rectangular container 1 that is closed on top by a cover 2. The cover 2 can be pivoted or folded relative to the container 1 about a pivot axis a in order to open and close the container 1. To this end, the cover 2 is attached to the container 1 by two hinges 3 provided on the rim of the cover 2.

Figure 2:
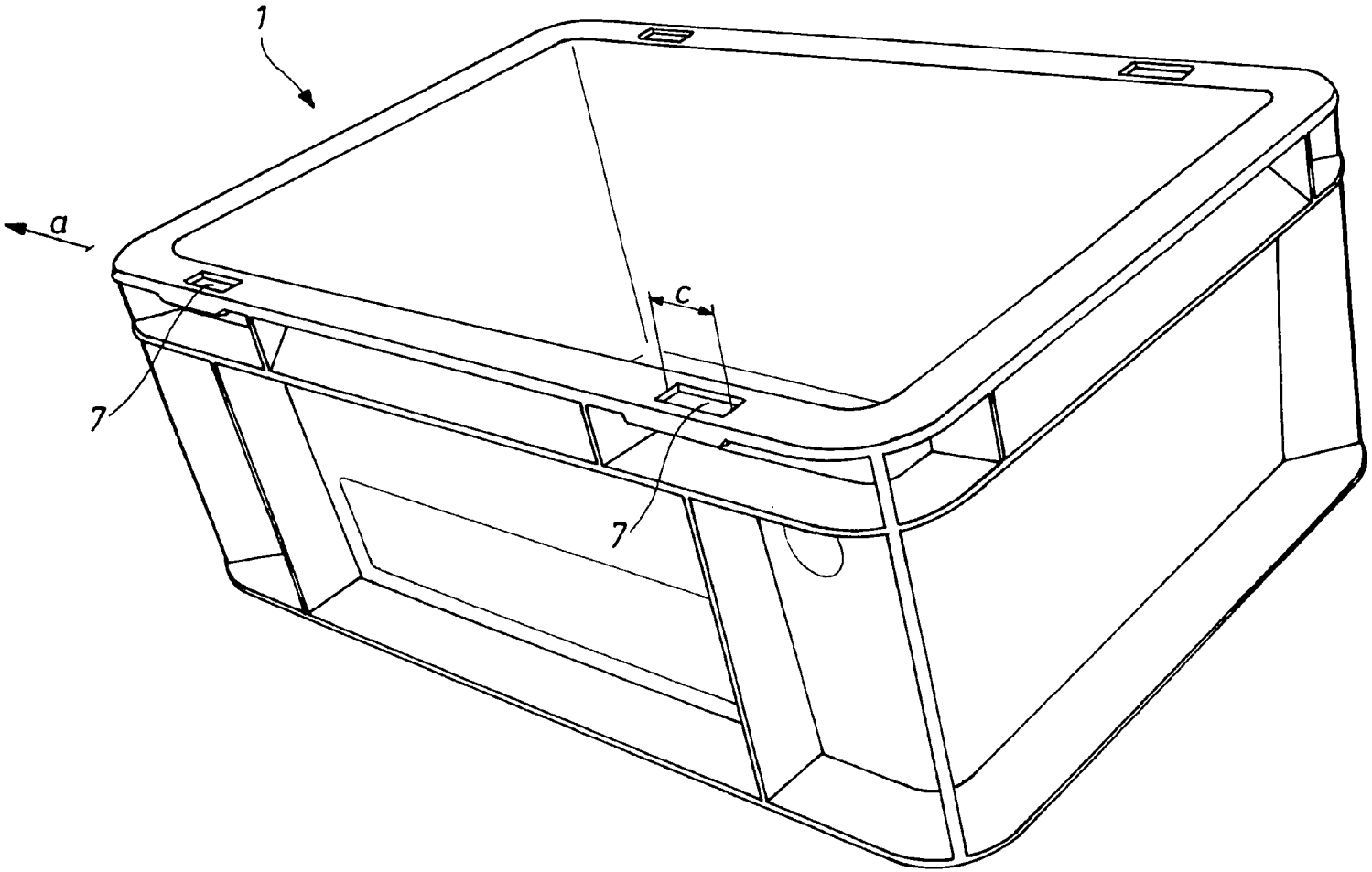
FIG. 2 is a perspective view of the container without the cover.
Figure 3:
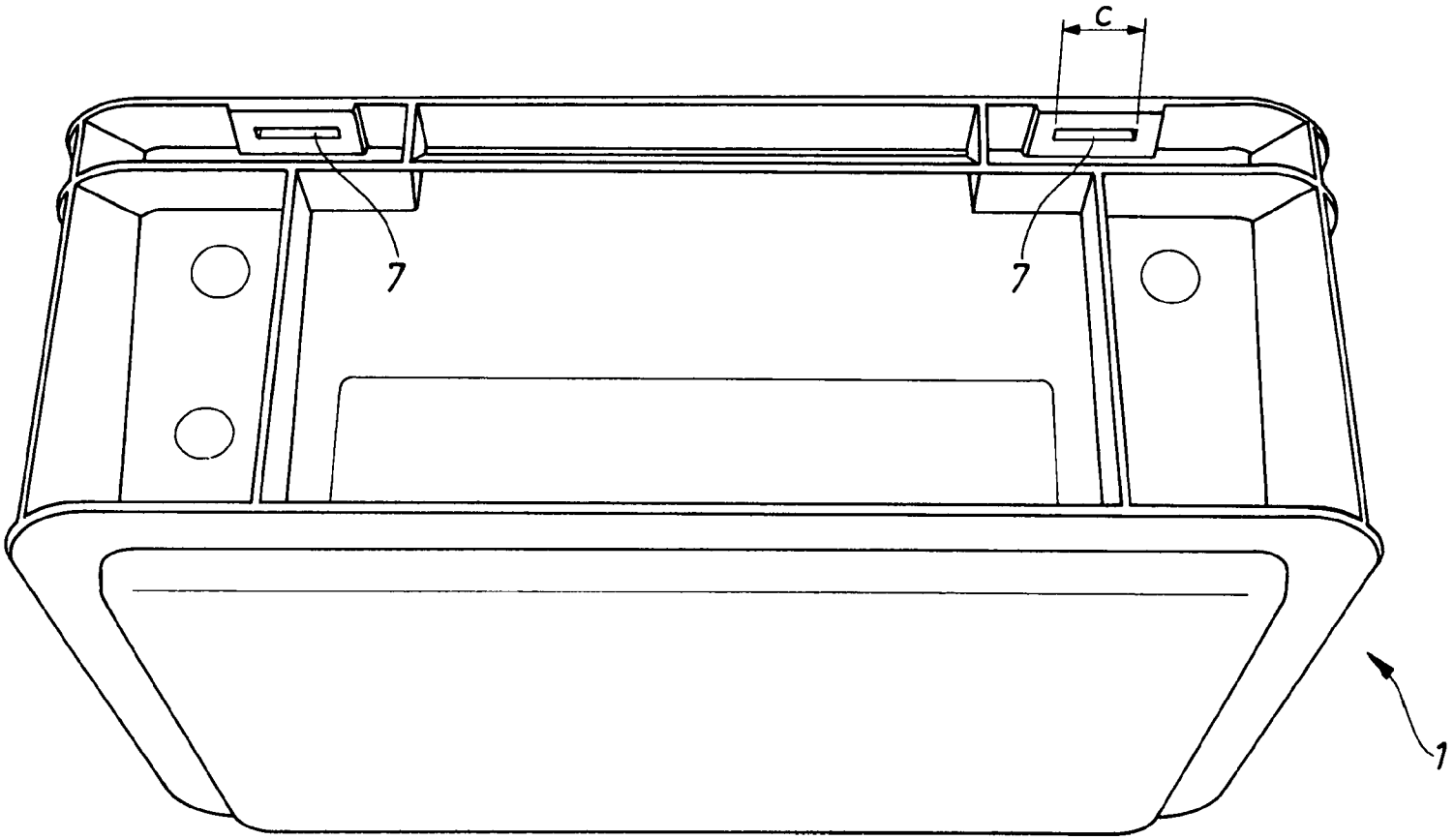
FIG. 3 is a perspective view like FIG. 2 of the container without its cover but viewed from below.

With the cover 2 removed, FIG. 2 reveals that the upper rim of the container 1 is formed with two slots 7 in a horizontally is extending wall portion. These slots 7 are formed during injection molding of the container 1 from plastic. It is of course also possible to form them at a later time. Measured parallel to the pivot axis a, the slots 7 are of a length c. This can also be seen again in FIG. 3 where the container 1 is viewed from below.

Figure 4:
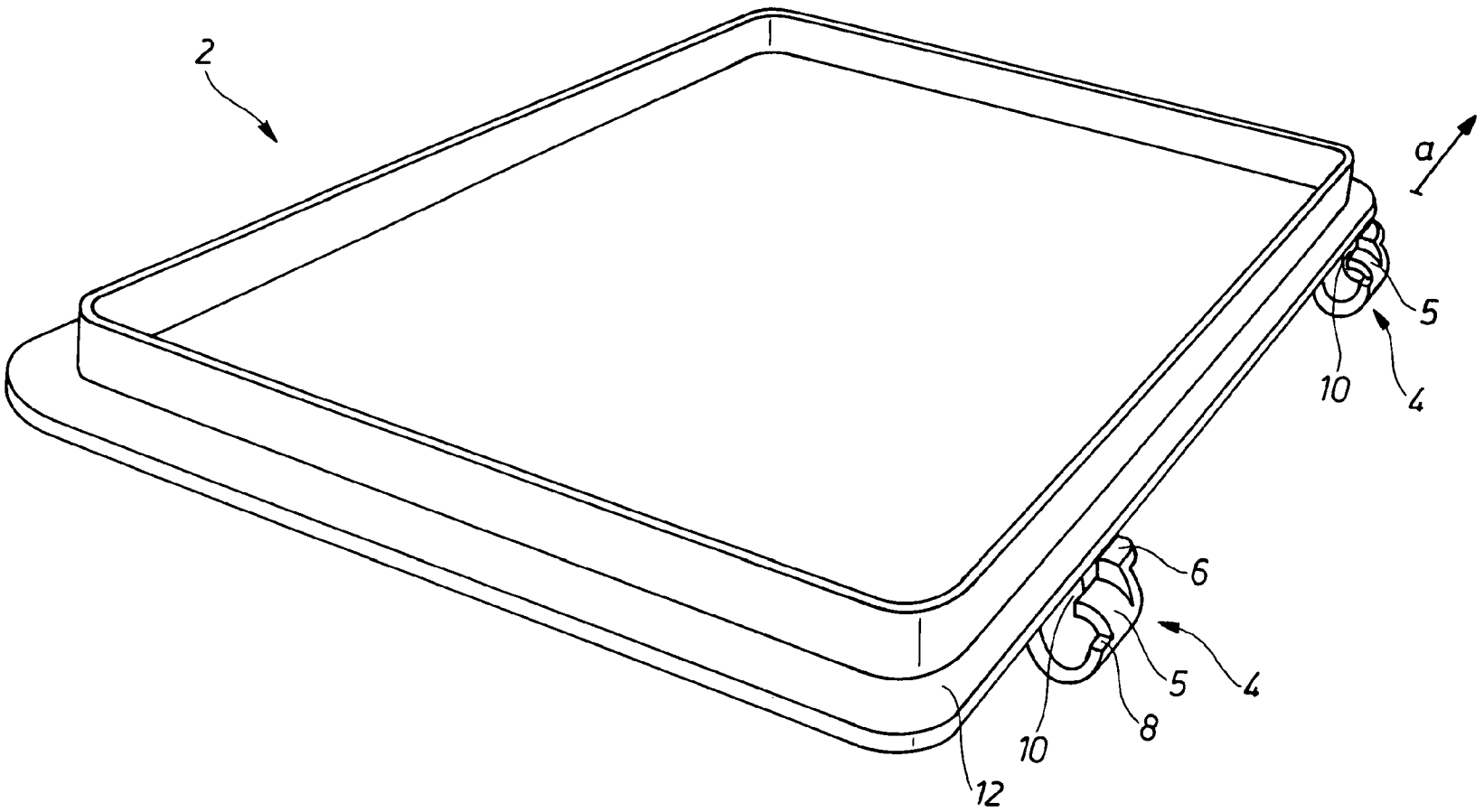
FIG. 4 is a perspective view of the bottom side of the cover.

FIG. 4 shows the cover 2 as a separate component. The inner face of the cover is shown facing upward. Two hinge knuckles 4 are molded onto the cover 2 along one edge 12, these hinge knuckles having been formed simultaneously with the injection molding of the cover 2. The central section of each hinge knuckle 4 is an arcuate—more precisely: cylindrically tubular—wall section 5 that creates a nearly closed sleeve; however, the wall section 5 delimits an open slit 10. As shown in more detail below, the function of this slit is to enable the wall section 5 to be inserted into the slot 7 of the container 1.

Figure 5:
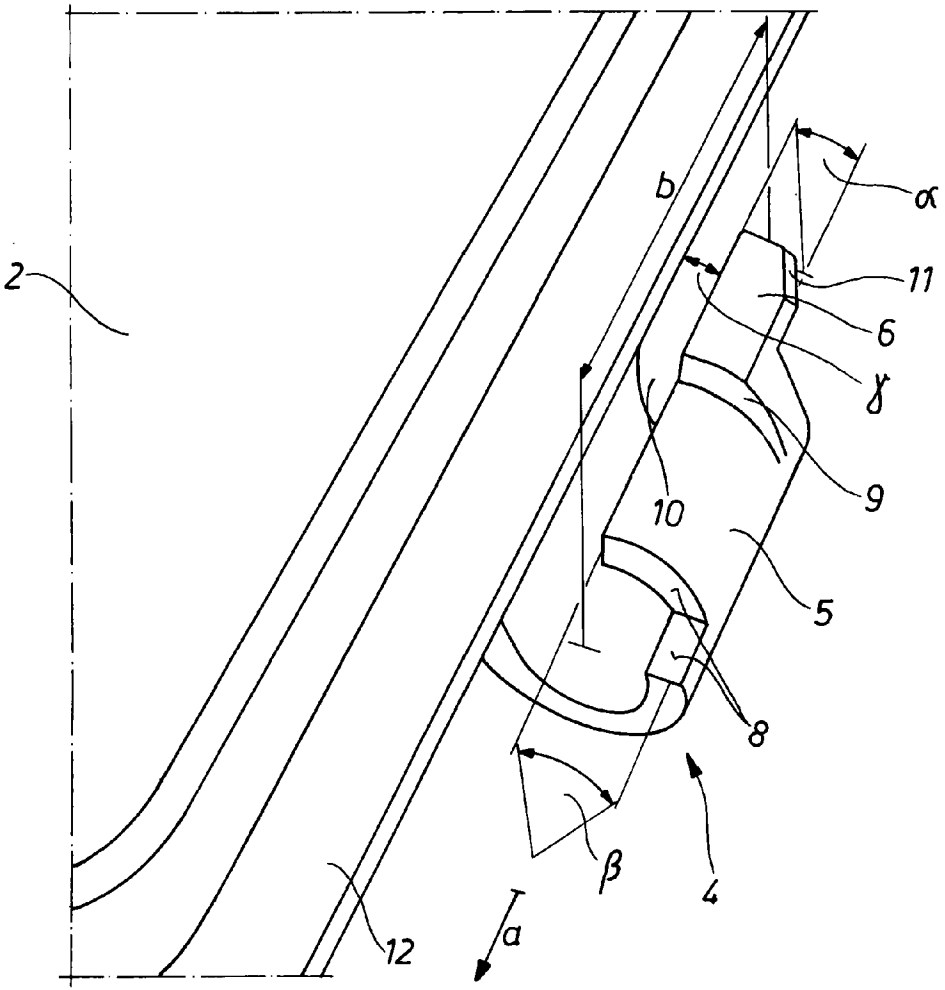
FIG. 5 is a perspective detail view of a hinge knuckle on the cover.
Figure 6:
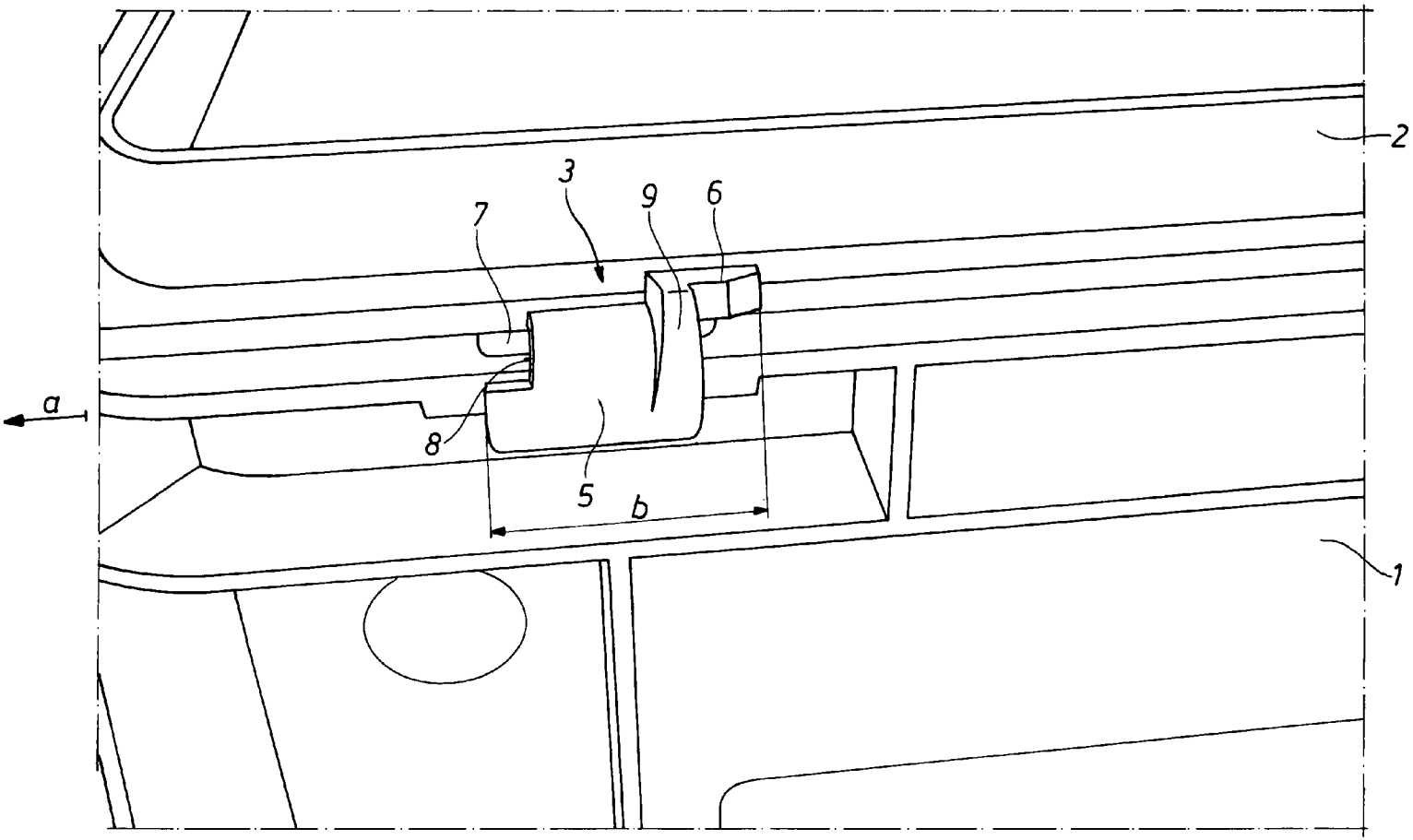
FIG. 6 is a perspective view of a part of the container together with its cover.

The arcuate part-cylindrically tubular wall section 5 has two special characteristics as most clearly shown in FIGS. 5 and 6: First, a lug 6 is molded onto the wall section 5 and extends parallel to the pivot axis a. Second, the wall section 5 is formed on the end of the hinge knuckle 4 opposite the lug with a cutout 8 that can be called a corner notch.

The lug 6 does not extend axially in a straight line from the wall section 5 but is angled. More specifically, the lug 6 is joined to the wall section 5 at a step-like shoulder 9, i.e. the lug 6 is offset radially somewhat outward of the part-cylindrical outer surface of the wall section 5.

In addition, the lug 6 has a flat or chamfer 11 on its outer end opposite the hinge knuckle 4.

The length of the wall section 5 together with the lug 6—measured parallel to the pivot axis a—is shown at b. The essential aspect is that this length b is greater than the length c of the slot 7. The length b preferably ranges between approximately 105% and 140% of the length c, especially preferably between 110% and 130% of the length c.

FIG. 5 furthermore shows that the following defined values are specified in each case for the size of the slit 10, for the angular dimension of the lug 6, and for the angular dimension of the cutout 8.

The lug 6 extends through an angle $\alpha$ about the central axis of hollow-cylindrical the wall section 5. This angle preferably ranges between 15° and 45°.

The cutout 8 (notch) extends through an angle $\beta$ about the central axis of hollow-cylindrical the wall section 5. This angle also preferably ranges between 15° and 45°.

The slit 10 extends through an angle $\gamma$ about the central axis of the part-cylindrical wall section 5. This angle preferably ranges between 10° and 45°.

Figure 7:
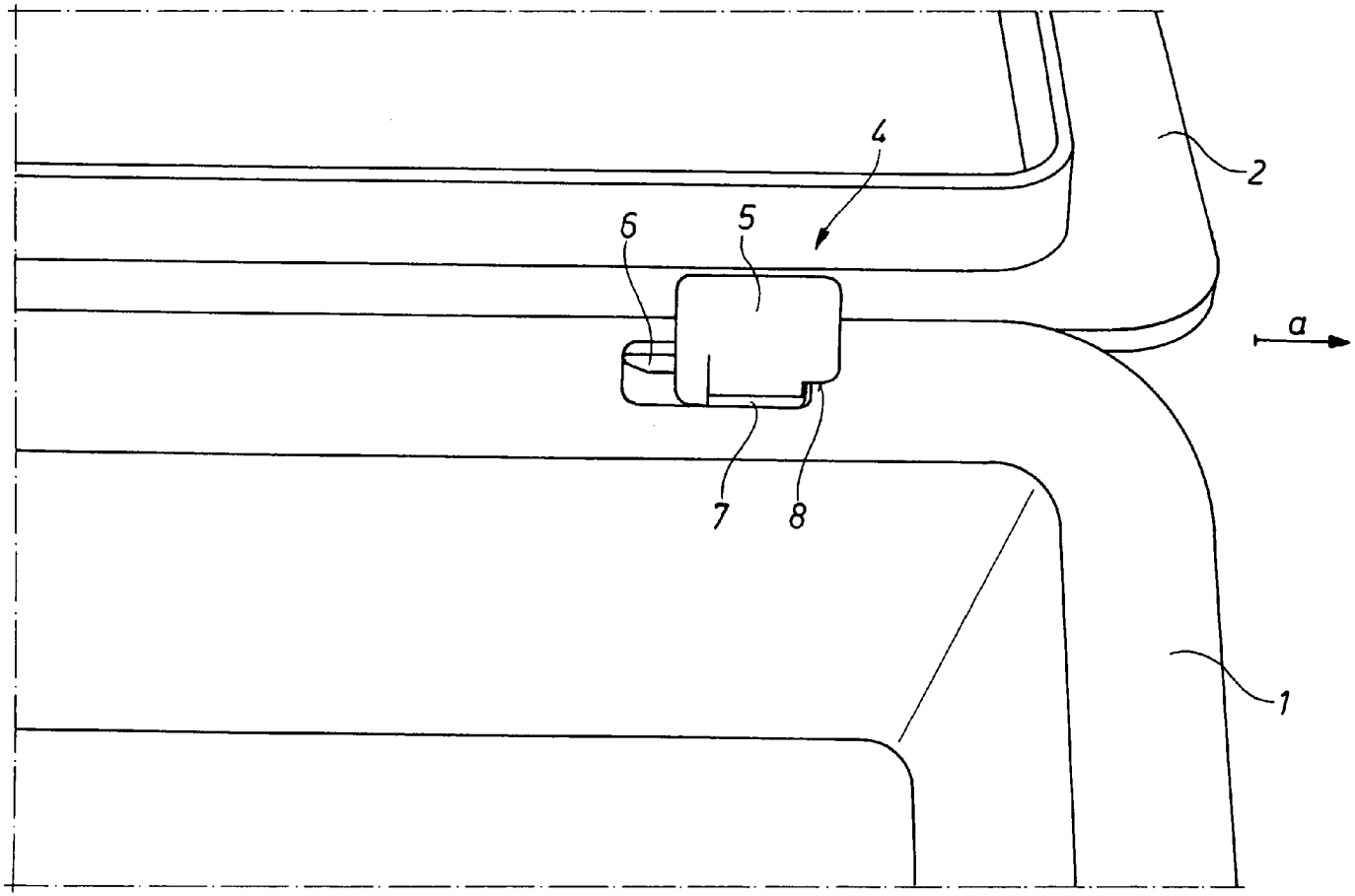
FIG. 7 is a perspective view of the container together with its cover during a first step of installing the cover on the container.
Figure 8:
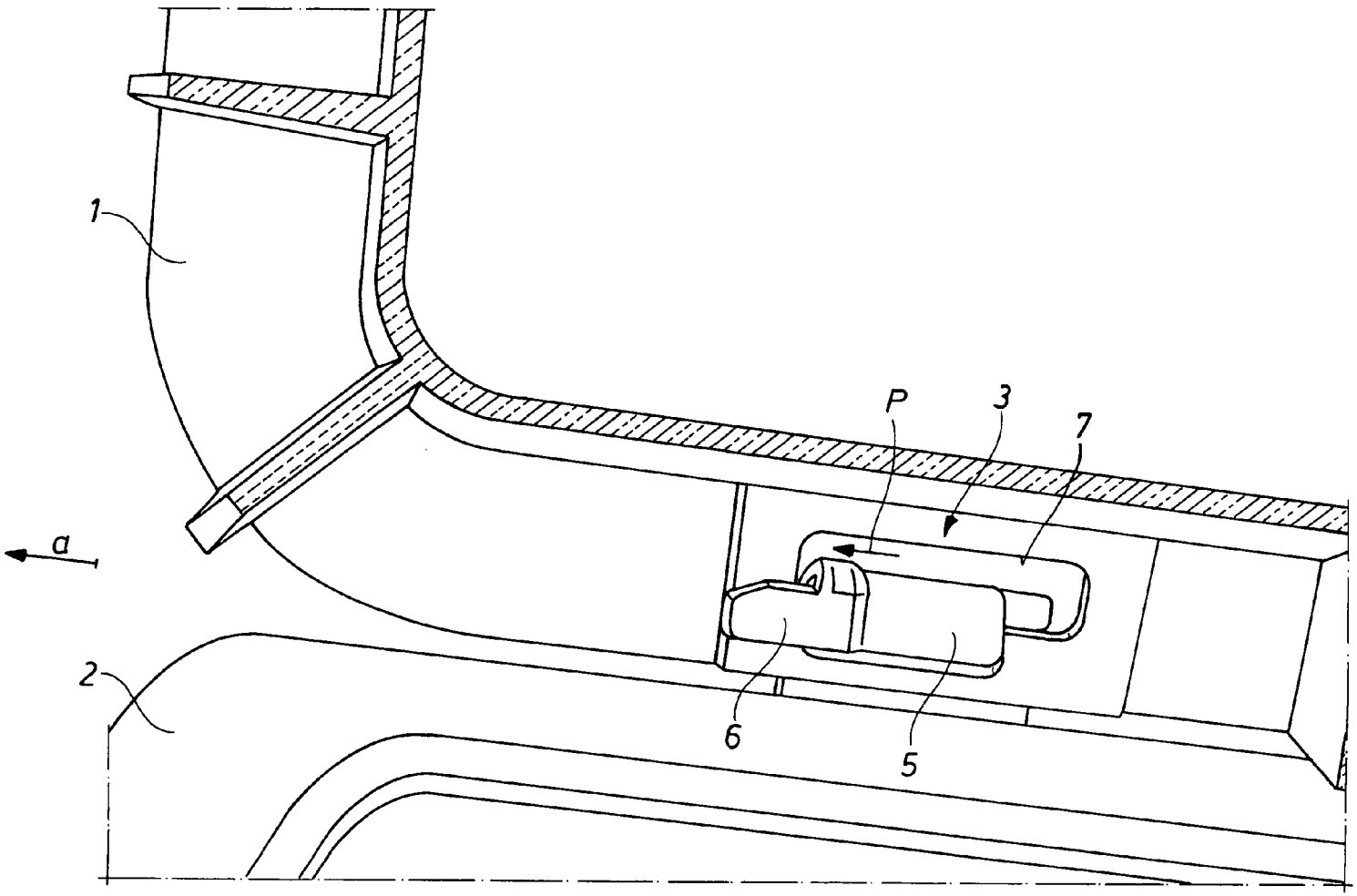
FIG. 8 is a perspective view of the container together with its cover during a second step of installing the cover on the container.

FIGS. 7 and 8 show how the cover 2 is installed on the container 1; i.e., the figures show the installation sequence for attaching the cover.

The hinge knuckle 4 with the lug 6 is first inserted into the slot 7 until the illustrated position of the cover 2 relative to the container 1 is assumed. The fact that the illustrated position of the hinge knuckle 4 can be assumed without generating stresses in the material is due to the cutout 8.

The actions following this are: placement of the hinge knuckles 4 on the opening cross-section of the container slots 7 by a length that reaches from the lug 6 to the corner notch 8 and fits the container slot 7, then insertion with inward pivoting of the cover forward in the drawing plane until the curved hinge section bears with the corner notch 8 on the container's upper rim.

The lug(s) 6 is/are then located below the container's upper rim. Simply sliding the cover (see sliding arrow P in FIG. 8) enables the lugs 6 engaged under the container's upper rim, to be shifted out of the opening cross-sections of the container slots 7, and to open the path for the hinge wall section 5 with the corner notches 8, as shown in FIG. 8 as viewed here from the bottom of the container's upper rim.

Figure 9:
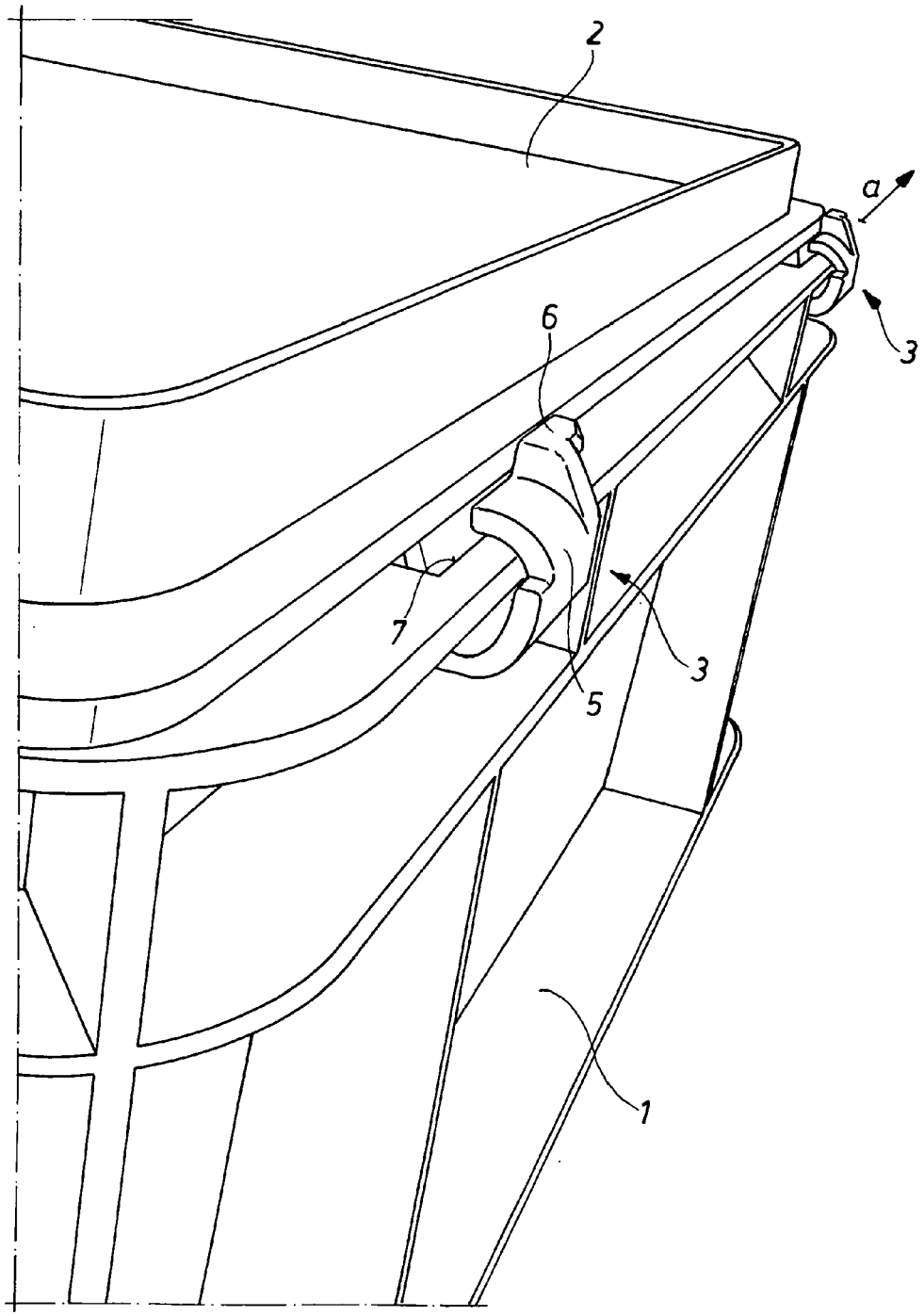
FIG. 9 is the perspective view of the container together with its cover after the cover has been installed on the container and closed.

The completely installed cover 2 together with captive attachment to the container 1 is illustrated in FIG. 9.

When the cover 2 is then folded or pivoted forward to close the container 1 in the drawing plane by approximately 180°, the entire wall section 5 of the hinge knuckles 4 rotates into each the container slot 7.

The invention claimed is:

1. In a container having a cover that is attached to the container by at least two hinges so that the cover can be opened and closed by pivoting about an axis relative to the container, the improvement wherein each hinge comprises a hinge knuckle on the cover and having an arcuate wall section onto which a lug is molded that extends generally parallel to the pivot axis, a slot formed in an upper rim of the container receives the arcuate wall section and extending parallel to the pivot axis, a length of the arcuate wall section measured generally parallel to the pivot axis together with the molded-on lug is greater than a length of the slot generally parallel to the pivot axis, the lug extends angularly around an outer surface portion of the arcuate wall section, the arcuate wall section is formed with a cutout in an end of the wall section opposite the lug, and the cutout extend over the same outer surface portion of the arcuate wall section.

2. The container defined in claim 1, wherein the arcuate wall section is cylindrically tubular.

3. The container defined in claim 1, wherein the outer surface portion including the lug extends through an angle of between 15° and 45°.

4. The container claim 1, wherein the cutout extends through an angle of between 15° and 45°.

5. The container claim 1, wherein the length of the lug generally parallel to the pivot axis ranges between 75% and 125% of the length of the cutout measured generally parallel to the pivot axis.

6. The container defined in claim 5, wherein the length of the lug measured generally parallel to the pivot axis and the length of the cutout measured generally parallel to the pivot axis are the same.

7. The container defined in claim 1, wherein the lug with radial offset is on a radial outer surface of the arcuate wall section.

8. The container defined in claim 7, wherein the radial offset is formed by a shoulder.

9. The container claim 1, wherein the arcuate wall section is molded onto the cover so as to form a slit extending generally parallel to the pivot axis.

10. The container defined in claim 9, wherein the slit extends through an angle of between 10° and 45° of the arcuate wall section.

11. The container claim 1, wherein the lug includes at least one flat or chamfer in its end opposite the arcuate wall section.

12. The container claim 1, wherein the arcuate wall section is molded as one integrated piece with the cover and is composed of the same material as the cover.

* * * * *